US010337272B2

(12) United States Patent
Howard et al.

(10) Patent No.: US 10,337,272 B2
(45) Date of Patent: Jul. 2, 2019

(54) HYBRID ROLLER CONE AND JUNK MILL BIT

(71) Applicant: Varel International Ind., L.P., Carrollton, TX (US)

(72) Inventors: Johnathan Walter Howard, Conroe, TX (US); Matthew Charles Stroever, Spring, TX (US); Sterling Robinson, Houston, TX (US)

(73) Assignee: VAREL INTERNATIONAL IND., L.P., Carrollton, TX (US)

( * ) Notice: Subject to any disclaimer, the term of this patent is extended or adjusted under 35 U.S.C. 154(b) by 50 days.

(21) Appl. No.: 15/400,163

(22) Filed: Jan. 6, 2017

(65) Prior Publication Data

US 2017/0234092 A1 Aug. 17, 2017

Related U.S. Application Data

(60) Provisional application No. 62/295,746, filed on Feb. 16, 2016.

(51) Int. Cl.

| | |
|---|---|
| ***E21B 29/00*** | (2006.01) |
| ***E21B 10/14*** | (2006.01) |
| ***E21B 10/567*** | (2006.01) |

(52) U.S. Cl.

CPC ..... *E21B 29/00* (2013.01); *E21B 10/14* (2013.01); *E21B 10/567* (2013.01)

(58) Field of Classification Search

CPC ..... E21B 10/14; E21B 10/00; E21B 10/30; E21B 29/00

See application file for complete search history.

(56) References Cited

U.S. PATENT DOCUMENTS

| | | | | |
|---|---|---|---|---|
| 3,142,110 | A * | 7/1964 | Hertel | B23B 27/16 407/109 |
| 3,978,933 | A | 9/1976 | Olson et al. | |
| 4,690,228 | A * | 9/1987 | Voelz | E21B 10/18 175/24 |
| 4,995,887 | A * | 2/1991 | Barr | B23P 5/00 51/293 |
| 5,957,629 | A * | 9/1999 | Hessman | B23C 5/202 407/113 |
| 8,678,111 | B2 | 3/2014 | Zahradnik et al. | |
| 8,985,247 | B2 | 3/2015 | Tamez et al. | |
| 9,033,069 | B2 | 5/2015 | Zhang et al. | |
| 9,376,866 | B2 | 6/2016 | Nobile et al. | |
| 2007/0079995 | A1* | 4/2007 | McClain | E21B 10/43 175/426 |

(Continued)

OTHER PUBLICATIONS

Rose, K., Nobile, K., Rodriguez, V., & Rose, R. (Mar. 17, 2015). Frac Plug Drill Out Benefits from Hybrid Roller Cone Bit Design. Society of Petroleum Engineers. doi:I0.2118/173127-MS (Year: 2015).*

*Primary Examiner* — David J Bagnell
*Assistant Examiner* — Theodore N Yao

(57) ABSTRACT

A hybrid bit for use in a wellbore includes: a body having a shank for connection to a drilling motor or drill pipe and a plurality of legs attached to the shank; and a plurality of cutting structures. The cutting structures include a roller cone mounted to a first one of the legs and a fixed mill mounted to a second one of the legs and including a pad dressed with a cermet material.

19 Claims, 7 Drawing Sheets

(56) References Cited

U.S. PATENT DOCUMENTS

| | | | | |
|---|---|---|---|---|
| 2010/0038146 | A1* | 2/2010 | Felderhoff | E21B 10/16 175/374 |
| 2010/0155145 | A1* | 6/2010 | Pessier | E21B 10/14 175/336 |
| 2011/0079444 | A1* | 4/2011 | Kulkarni | E21B 10/14 175/371 |
| 2013/0313021 | A1 | 11/2013 | Zahradnik et al. | |
| 2014/0186128 | A1* | 7/2014 | Nedzlek | B23C 3/055 407/44 |
| 2015/0226007 | A1 | 8/2015 | Harrington et al. | |
| 2015/0233187 | A1 | 8/2015 | King | |

* cited by examiner

HYBRID ROLLER CONE AND JUNK MILL BIT

BACKGROUND OF THE DISCLOSURE

Field of the Disclosure

The present disclosure generally relates to a hybrid roller cone and junk mill bit.

Description of the Related Art

U.S. Pat. No. 8,678,111 discloses a hybrid earth-boring bit including a bit body having a central axis, at least one, preferably three fixed blades, depending downwardly from the bit body, each fixed blade having a leading edge, and at least one rolling cutter, preferably three rolling cutters, mounted for rotation on the bit body. A rolling cutter is located between two fixed blades.

U.S. Pat. App. Pub. No. 2013/0313021 discloses an earth boring drill bit having a bit body having a central longitudinal axis that defines an axial center of the bit body and configured at its upper extent for connection into a drillstring; at least one primary fixed blade extending downwardly from the bit body and inwardly toward, but not proximate to, the central axis of the drill bit; at least one secondary fixed blade extending radially outward from proximate the central axis of the drill bit; a plurality of fixed cutting elements secured to the primary and secondary fixed blades; at least one bit leg secured to the bit body; and a rolling cutter mounted for rotation on the bit leg; wherein the fixed cutting elements on at least one fixed blade extend from the center of the bit outward toward the gage of the bit but do not include a gage cutting region, and wherein at least one roller cone cutter portion extends from substantially the drill bit's gage region inwardly toward the center of the bit, the apex of the roller cone cutter being proximate to the terminal end of the at least one secondary fixed blade, but does not extend to the center of the bit.

U.S. Pat. App. Pub. No. 2015/0053422 discloses a hybrid rotary cone drill bit including a plurality of legs. A bearing shaft extends from each leg, and a rotary cone is rotationally coupled to each bearing shaft. At least one rotary cone includes a nose row of cutting structures, an inner row of cutting structures, and a gage row of cutting structures. The nose row and the inner row of cutting structures are formed of milled teeth. The gage row of cutting structures is formed of cutter inserts.

U.S. Pat. App. Pub. No. 2015/0233187 discloses a fixed cutter bit for milling a frac plug including a body and a face. The face includes a base surface and a plurality of cutter support structures extending from the base surface. Each cutter support structure has a peripheral portion and an inner portion disposed radially internal of the peripheral portion. At least one first-type cutter is supported by each peripheral portion; at least one second-type cutter is supported by each inner portion. The first type cutter is adapted to mill a harder material than the second-type cutter, and the first-type is different from the second-type.

SUMMARY OF THE DISCLOSURE

The present disclosure generally relates to a hybrid roller cone and junk mill bit. In one embodiment, a hybrid bit for use in a wellbore includes: a body having a shank for connection to a drilling motor or drill pipe and a plurality of legs attached to the shank; and a plurality of cutting structures. The cutting structures include a roller cone mounted to a first one of the legs and a fixed mill mounted to a second one of the legs and including a pad dressed with a cermet material.

In another embodiment, a junk mill for use in a wellbore includes: a body having a shank for connection to a drilling motor or drill pipe; a plurality of fixed cutting structures mounted to the body, each cutting structure including a pad dressed with a cermet material; and a junk chute for accommodating milling of a pump-down plug. The junk chute includes a diverter groove formed in a first one of the pads and a junk slot formed between the first and an adjacent second one of the pads and having an entrance located adjacent to the diverter groove.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1:
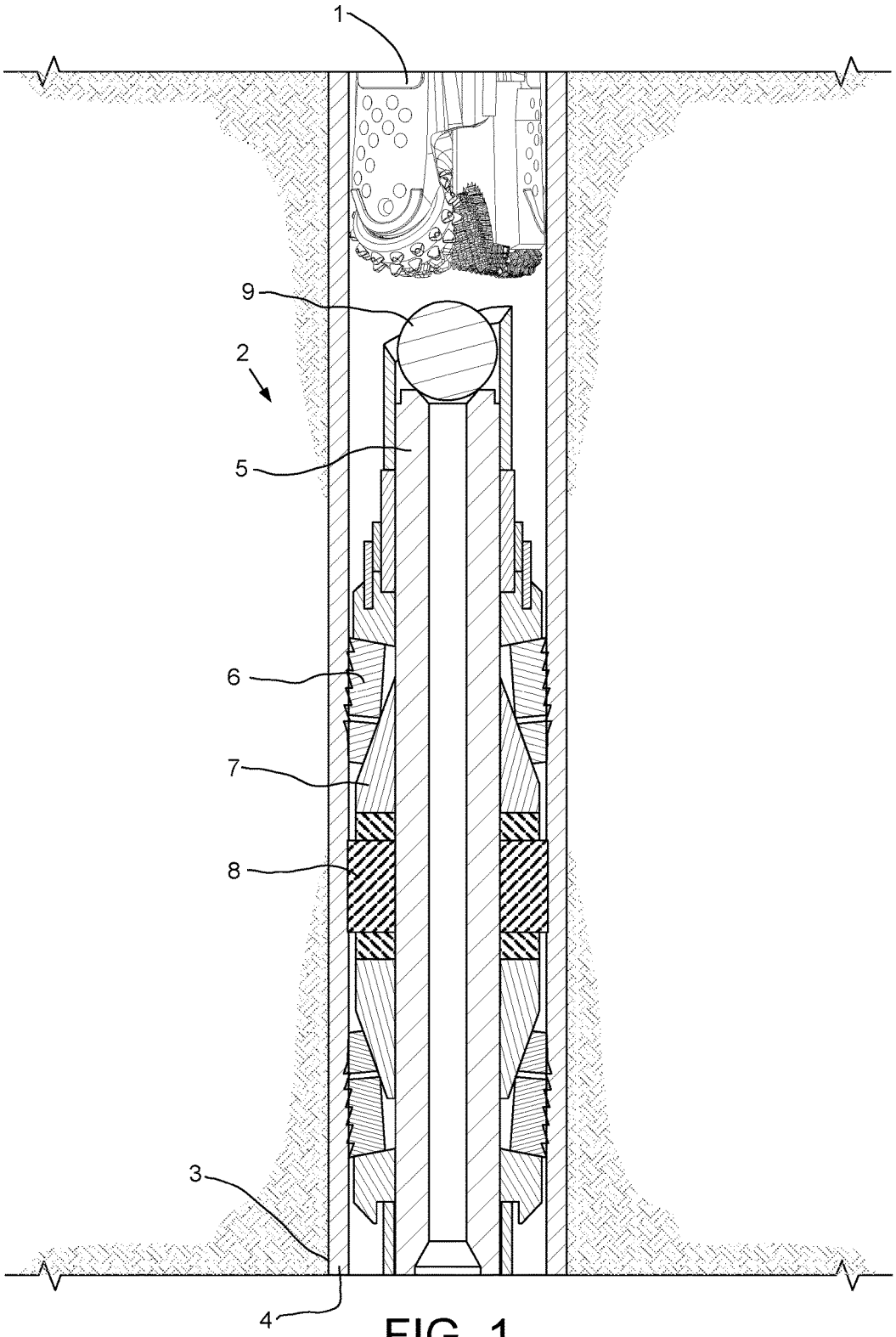
FIG. 1 illustrates a hybrid rotary cone and junk mill bit positioned for drilling out a frac plug set in a wellbore, according to one embodiment of the present disclosure.

FIG. 1 illustrates a hybrid rotary cone and junk mill bit 1 positioned for drilling out a frac plug 2 set in a wellbore 3, according to one embodiment of the present disclosure. For a hydraulic fracturing operation, the frac plug 2 is set against a casing or liner string 4 to isolate a zone (not shown) of a formation adjacent to the wellbore 3. To set the frac plug 2, a setting tool (not shown) and the frac plug 2 may be deployed down the casing or liner string 4 using a wireline (not shown). The frac plug 2 may be set by supplying electricity to the setting tool via the wireline to activate the setting tool. A piston of the setting tool may move an outer portion of the frac plug 2 along a mandrel 5 of the frac plug while the wireline restrains a mandrel of the setting tool and the plug mandrel, thereby compressing a packing element 8 and driving slips 6 along respective slip cones 7 of the frac plug. The packing element 8 may be radially expanded into engagement with the casing or liner string 4 and the slips 6 may be wedged into engagement therewith.

The casing or liner string 4 may then be perforated above the set frac plug 2 and the isolated zone may be hydraulically fractured by pumping a ball 9 followed by fracturing fluid (not shown) down the casing or liner string 4. The ball 9 may land in a seat of the plug mandrel 5, thereby forcing the fracturing fluid into the zone via the perforations. Another frac plug (not shown) may then be set above the fractured zone and the casing or liner string 4 may again be perforated above the plug for hydraulic fracturing of another zone. This process may be repeated many times, such as greater than or equal to ten or twenty times, until all of the zones adjacent to the wellbore 3 have been fractured.

After all of the zones have been fractured, a production valve at the wellhead may be opened to produce fluid from the wellbore in an attempt to retrieve the balls 9. However, this attempt often fails. The hybrid bit 1 (only partially shown) may be deployed down the casing or liner string 4 using coiled tubing (not shown). A drilling motor (not shown), such as a mud motor, may connect the hybrid bit 1 to the coiled tubing. The hybrid bit 1, drilling motor, and coiled tubing may be collectively referred to as a mill string. Milling fluid may be pumped down the coiled tubing, thereby driving the drilling motor to rotate the hybrid bit 1 and the hybrid bit may be advanced into engagement with the frac plug 2, thereby drilling out the frac plug. Once drilled out, the mill string may be advanced to drill out the next frac plug 2 until all of the frac plugs have been drilled out.

Alternatively, the mill string may include a string of drill pipe instead of coiled tubing with or without the drilling motor. Alternatively, the hybrid bit 1 may be employed to drill out other types of downhole tools, such as packers, bridge plugs, float collars, float shoes, stage collars, guide shoes, reamer shoes, and/or casing bits.

Figure 2:
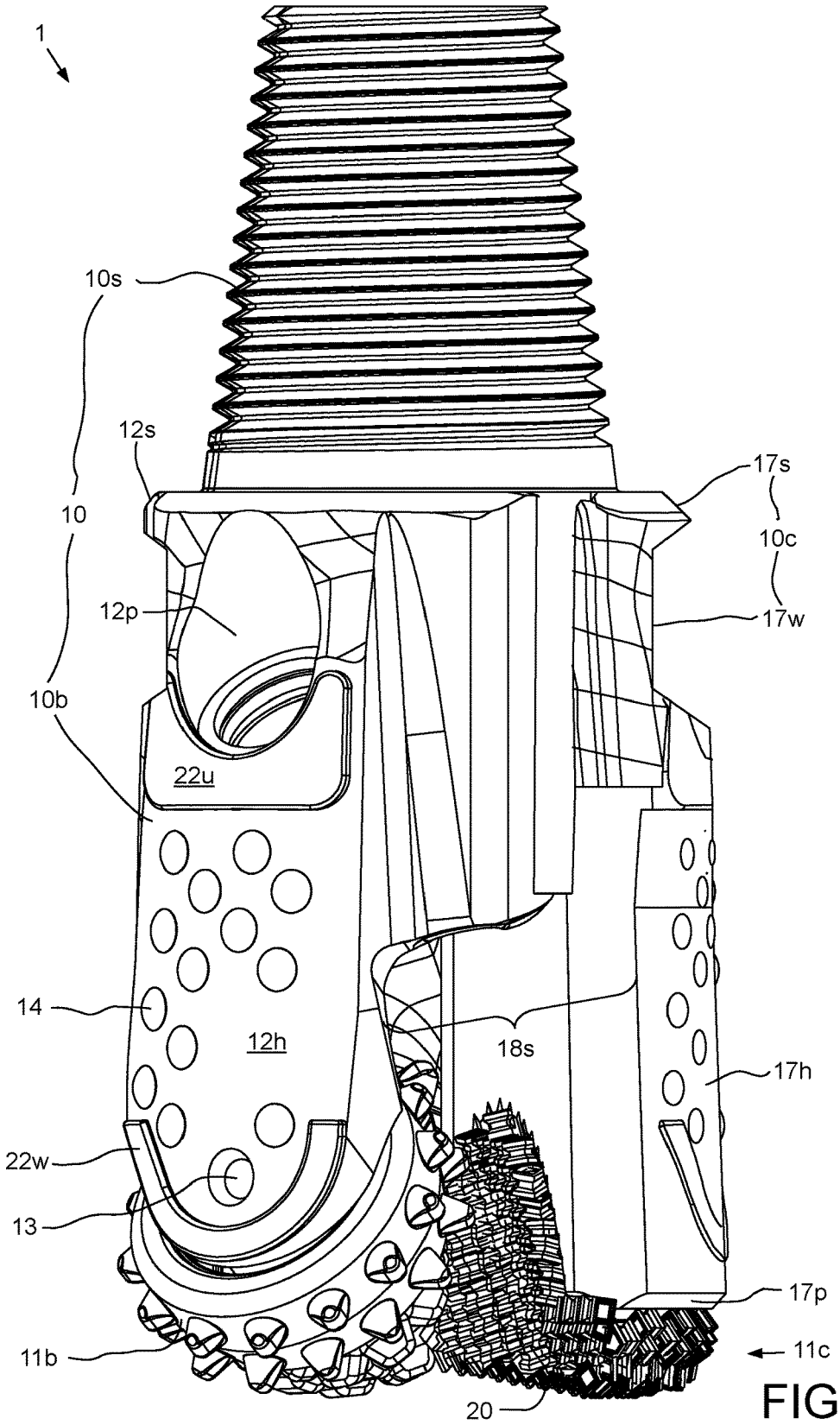
FIGS. 2 and 3 illustrate the hybrid bit.
Figure 3:
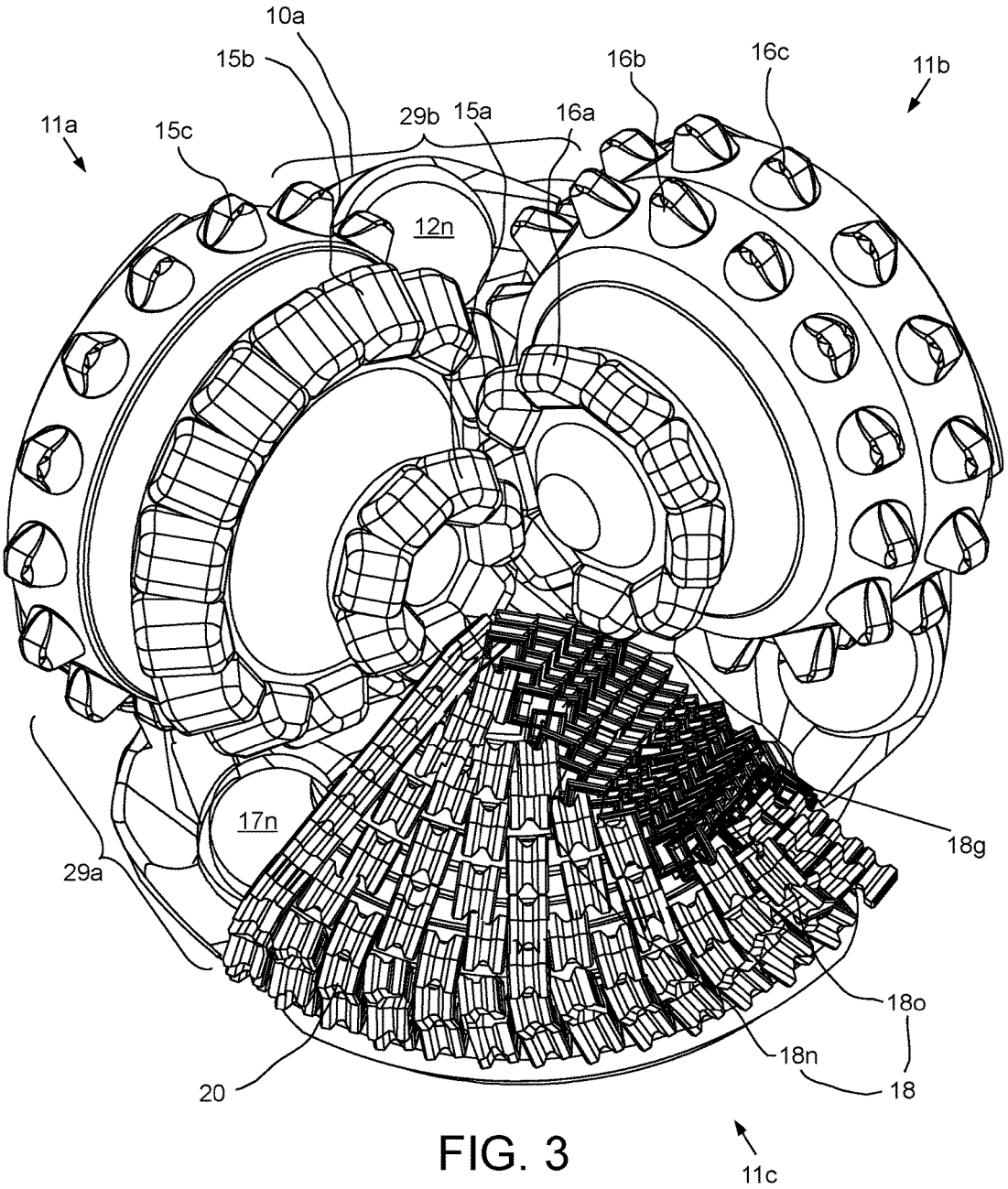

FIGS. 2 and 3 illustrate the hybrid bit 1. The hybrid bit 1 may include a body 10 and a plurality of cutting structures, such as one or more roller cones 11*a,b* and a fixed mill 11*c*. The body 10 may have an upper shank 10*s* and a lower leg 10*a-c* for each cutting structure 11*a-c*. The body 10 may be made from a metal or alloy, such as steel. Each leg 10*a-c* may be attached to the shank 10*s*, such as by welding. The legs 10*a-c* may be equally spaced around the body 10, such as three at one hundred twenty degrees. The shank 10*s* may have a coupling, such as a threaded pin, formed at an upper end thereof for connection to the drilling motor or drill pipe. A bore (not shown) may be formed in the shank 10*s* and may extend from an upper end thereof to a plenum formed therein adjacent to a lower end thereof.

Each leg 10*a,b* may have an upper shoulder 12*s*, a mid shirttail 12*h*, a lower bearing shaft (not shown), and a ported boss 12*n*. The shoulder 12*s*, shirttail 12*h*, ported boss 12*n*, and bearing shaft of each leg 10*a,b* may be interconnected, such as by being integrally formed and/or welded together. Each ported boss 12*n* may be in fluid communication with the plenum via a respective port formed in the shank 10*s* and may have a nozzle fastened therein for discharging the milling fluid onto the respective roller cone 11*a,b*. Each bearing shaft may extend from the respective shirttail 12*h* in a radially inclined direction. Each bearing shaft may have a journal for supporting rotation of the respective roller cone 11*a,b* therefrom. Each leg 10*a,b* may have a lubricant reservoir formed therein and a lubricant passage extending from the reservoir to the respective journal bearing formed between the bearing shaft and the respective roller cone 11*a,b*. The lubricant may be retained within the each leg 10*a,b* by a seal, such as an o-ring, positioned in a seal gland between the respective cone 11*a,b* and the bearing shaft. Each leg 10*a,b* may also have a fill port 12*p* in fluid communication with the lubricant reservoir and closed by a pressure compensator.

Each roller cone 11*a,b* may be mounted to the respective leg 10*a,b* by a plurality of balls (not shown) received in a race formed by aligned grooves in each roller cone and the respective bearing shaft. The balls may be fed to each race by a ball passage formed in each leg 10*a,b* and retained therein by a respective ball plug 13. Each ball plug 13 may be attached to the respective leg 10*a,b*, such as by welding. Upper and lower edges of each shirttail 12*h* may be protected from erosion and/or abrasion by respective hardfacing 22*u,w* with a ceramic or cermet material. An outer surface of each shirttail 12*h* may also be protected from erosion and/or abrasion by stabilizer inserts 14 secured into sockets thereof, such as by interference fit or brazing. Each insert 14 may be made from a cermet.

Each roller cone 11*a,b* may be made from a metal or alloy, such as steel. Each roller cone 11*a,b* may have a plurality of respective rows 15*a-c*, 16*a-c* of cutters, such as a nose row 15*a*, 16*a*, an inner row 15*b*, 16*b*, and a gage row 15*c*, 16*c* of cutters. The nose row 16*a* and the inner row 16*b* of the roller cone 11*b* may be offset relative to the respective nose row 15*a* and inner row 15*b* of the roller cone 11*a*. Each cutter of the nose rows 15*a*, 16*a* may be a milled tooth hardfaced by a cermet. Each cutter of the inner row 15*b* may be a milled tooth hardfaced by a ceramic or cermet material. Each cutter of the gage rows 15*c*, 16*c* may be a cermet insert mounted in sockets formed in the respective roller cone 11*a,b*, such as by interference fit or brazing. Each cutter of the inner row 16*b* may be a cermet insert mounted to the roller cone 11*b*, such as by interference fit or brazing. Each cermet insert may be chisel-shaped (shown) or conical (not shown).

Alternatively, each cutter of both inner rows 15*b*, 16*b* may be a hardfaced milled tooth. Alternatively, each cutter of both inner rows 15*b*, 16*b* may be a cermet insert. Alternatively, each cutter of the roller cones 11*a,b* may be a hardfaced milled tooth. Alternatively, each cutter of the roller cones 11*a,b* may be a cermet insert. Alternatively, each cutter of at least one row of either roller cone 11*a,b* may be a cermet insert and each cutter of at least one row of either roller cone 11*a,b* may be a hardfaced milled tooth.

The leg 10*c* may have an upper shoulder 17*s*, a mid shirttail 17*h*, a wrench profile 17*w*, a mill pad 17*p*, and a ported boss 17*n*. The shoulder 17*s*, shirttail 17*h*, mill pad 17*p*, and ported boss 17*n* of the leg 10*c* may be interconnected, such as by being integrally formed and/or welded together. The ported boss 17*n* may be in fluid communication with the plenum via a respective port formed in the shank 10*s* and may have a nozzle fastened therein for discharging the milling fluid onto the fixed mill cutting structure 11*c*. Upper and lower edges of each shirttail 17*h* may also be protected from erosion and/or abrasion by the hardfacing 22*u,w*. An outer surface of the shirttail 17*h* may also be protected from erosion and/or abrasion by the stabilizer inserts 14 mounted into sockets formed therein, such as by interference fit or brazing. The wrench profile 17*w* may be a flat and may be formed in the shirttail 17*h* adjacent to the shoulder 17*s*. Since the leg 10*c* does not need a lubricant reservoir, the space that would otherwise be occupied by the fill port 12*p* may be utilized for the wrench profile 17*w*, thereby obviating the need for a bit box to connect the hybrid bit 1 to the mill string. The hybrid bit 1 may further include a second wrench profile, such as a flat, formed in the ported boss 12*n* opposite to the leg 10*c*.

The hybrid bit 1 may further have a first junk slot 29*a* formed between the shirttail 12*h* of the leg 10*a* and the shirttail 17*h* of the leg 10*c* and a second junk slot 29*b* formed between the shirttails 12*h* of the legs 10*a,b*. The hybrid bit 1 may further have a junk chute 18 with a third junk slot 18*s*. Each junk slot 29*a,b*, 18*s* may be formed into the body 10, such as by milling and/or forging. Each ported boss 12*n*, 17*n* may be located in a respective junk slot 29*a,b*, 18*s*. Each junk slot 29*a,b*, 18*s* may be sized to allow passage of debris (not shown) created during milling of the frac plugs 2 into an annulus formed between the mill string and the casing or liner string 4.

The junk chute 18 may include a diverter groove 18*g* formed in the mill pad 17*p* and the third junk slot 18*s* formed between the shirttail 17*h* of the leg 10*c* and the shirttail 12*h* of the leg 10*b*. An entrance of the junk slot 18*s* may be located adjacent to the diverter groove 18*g*. The diverter groove 18*g* may be operable to receive and capture each ball 9 of the respective frac plug 2. The diverter groove 18*g* may be located along a leading edge of the mill pad 17*p* (see rotation arrow 19*a* in FIG. 6) such that the adjacent roller cone 11*b* rotates in a direction 19*b* for driving the ball 9 into the diverter groove. The diverter groove 18*g* may have an outer shoulder 18*o* shaped for trapping the ball 9 and an inner contour 18*n* for directing the ball toward the cutters of the adjacent roller cone 11*b*. The diverter groove 18*g* may also be longitudinally inclined such that a size thereof is greatest adjacent to a bottom of the mill pad 17*p* and decreases toward the junk slot 18*s*, thereby funneling the ball 9 toward the junk slot.

Figure 4A:
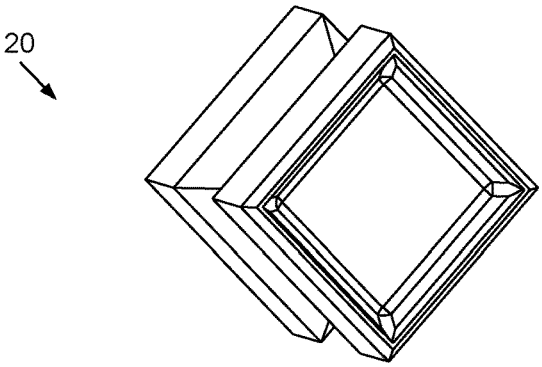
FIGS. 4A-4C illustrates a cutter of a fixed mill cutting structure of the hybrid bit.
Figure 4B:
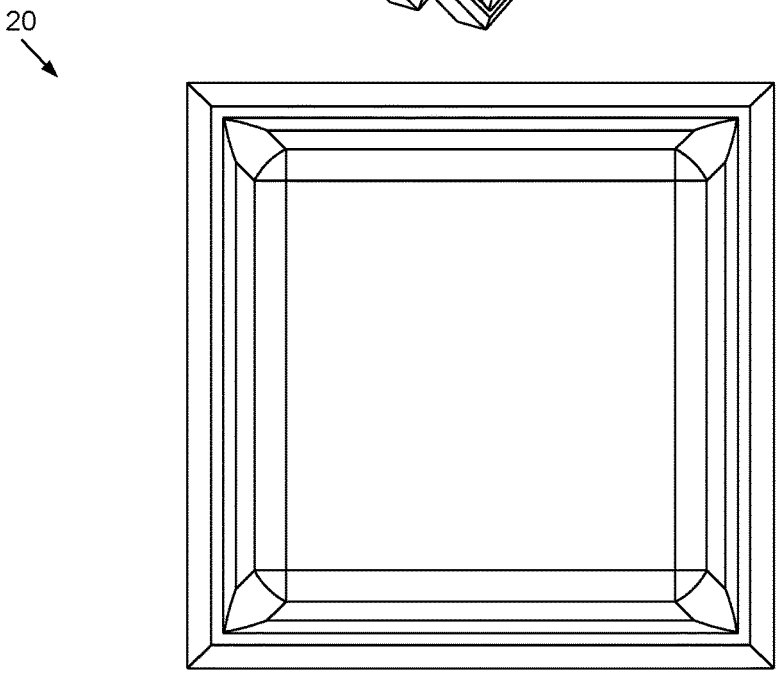
Figure 4C:
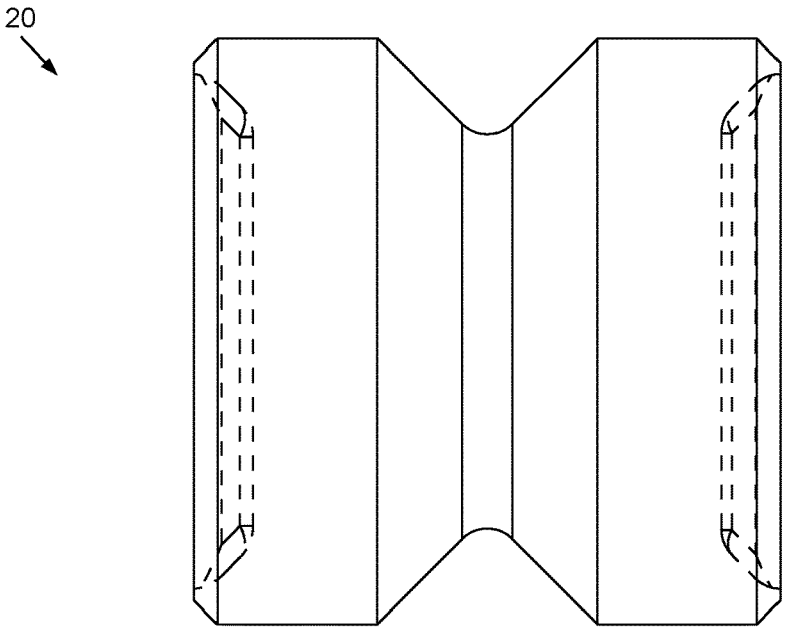

FIGS. 4A-4C illustrate a cutter 20 of the fixed mill cutting structure 11*c*. To form the fixed mill cutting structure 11*c*, the mill pad 17*p* (including the diverter groove 18*g*) may be dressed with cutters 20. Each cutter 20 may be a block, such as a cubic block, of cermet material. The cermet material may include a binder and carbide, such as cobalt-tungsten carbide. The cermet material may be formed into the block by sintering, such as hot pressing.

Each cutter 20 may have a pair of opposite rectangular sides and four profiled sides connecting the rectangular sides. The profiled sides may each have rectangular end portions located adjacent to the respective rectangular sides and profiled mid portions connecting the respective end portions. Each rectangular end portion may have chamfered corners adjacent to the respective rectangular sides. Each profiled portion may have a pair of opposed trapezoidal portions converging from the respective end portions toward a center of the cutter 20. Each profiled portion may further have a filleted rectangular center portion connecting ends of the trapezoidal portions distal from the respective end portions. Each rectangular side may have a raised peripheral portion and a recessed interior portion. Tapered walls may connect each raised peripheral portion to the respective interior portion. Each corner of the tapered walls may be shaved.

Figure 5A:
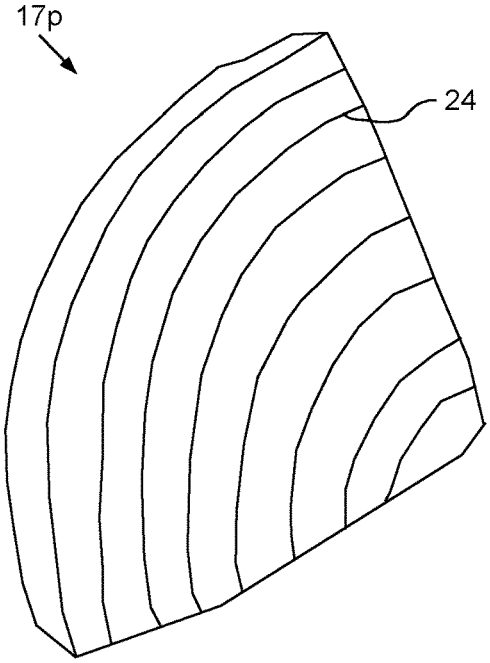
FIGS. 5A-5C illustrate mounting of the cutter to a mill pad of the hybrid bit.
Figure 5B:
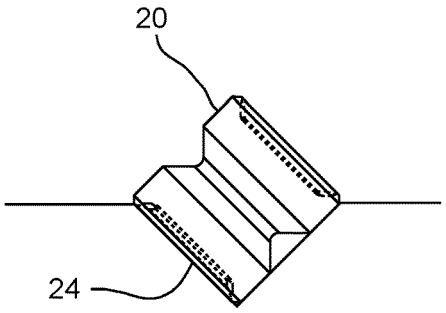
Figure 5C:
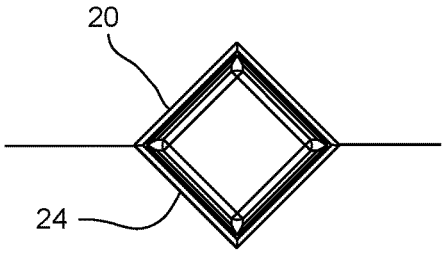

FIGS. 5A-5C illustrate mounting of the cutter 20 to the mill pad 17*p*. The diverter groove 18*g* has been omitted from the mill pad 17*p* for simplicity. The mill pad 17*p* may have circumferentially extending grooves 24 for dressing the mill pad with the cutters 20. The grooves 24 may each be vee-shaped to facilitate a desired orientation of the cutters 20 therein. The desired orientation may be either the orientation illustrated in FIG. 5B or the orientation illustrated in FIG. 5C.

Each cutter 20 may occupy only a small fraction of a surface of the mill pad 17*p* such that many cutters are necessary to dress the surface, such as greater than or equal to thirty cutters. The cutters 20 may be mounted in the respective grooves 24, such as by brazing. To facilitate the brazing operation, several cutters 20 may be combined in a rod (not shown) with a tinning binder which allows a welder (person or robot) to rapidly braze the cutters on the surfaces.

Alternatively, the mill pad 17*p* may be non-profiled and the cutters mounted thereto in a random orientation. Alternatively, the mill pad 17*p* may be hardfaced with a ceramic or cermet material instead of having the cutters 20 mounted thereto.

Figure 5D:
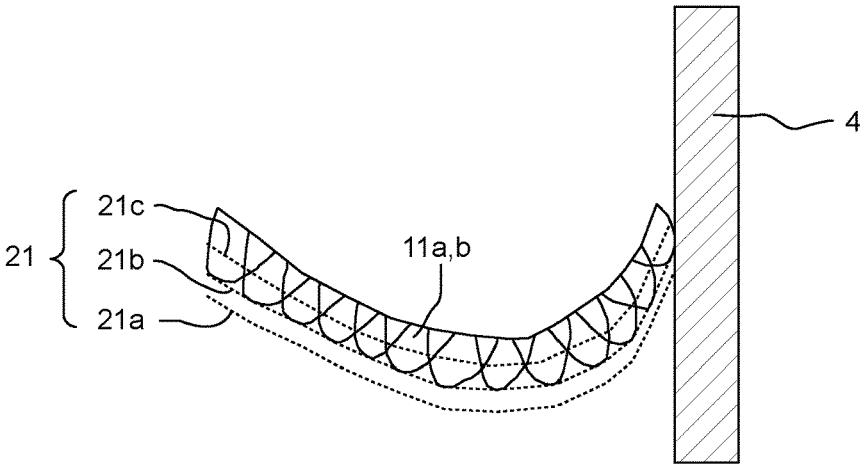
FIG. 5D illustrates exposure options of the fixed mill cutting structure relative to the roller cone cutting structures of the hybrid bit.

FIG. 5D illustrates exposure options of the fixed mill cutting structure 11*c* relative to the roller cone cutting structures 11*a,b*. The cutters 20 may be mounted on the mill pad 17*p* such that a cutting edge 21 thereof is over-exposed 21*a*, equally exposed 21*b*, or under-exposed 21*c* relative to a cutting edge of the roller cone cutting structures 11*a,b*. The over-exposure 21*a* means that the fixed mill cutting structure 11*c* will engage each frac plug 2 immediately before the roller cone cutting structures 11*a,b*. The under-exposure means that the fixed mill cutting structure 11*c* will engage each frac plug 2 immediately after the roller cone cutting structures 11*a,b*. Equal exposure 21*b* means that the fixed mill cutting structure 11*c* will engage each frac plug 2 contemporaneously with the roller cone cutting structures 11*a,b*. The exposure 21*a-c* may be selected according to the materials of each frac plug 2. If each frac plug 2 is primarily constructed of hard and brittle materials, such as cast iron, then underexposure 21*c* may be more beneficial as the less aggressive roller cone cutting structures 11*a,b* are more suitable thereto. If each frac plug 2 is primarily constructed of resilient materials, such as composites, then overexposure 21*c* may be more beneficial as the more aggressive cutters 20 are more suitable thereto.

Figure 6:
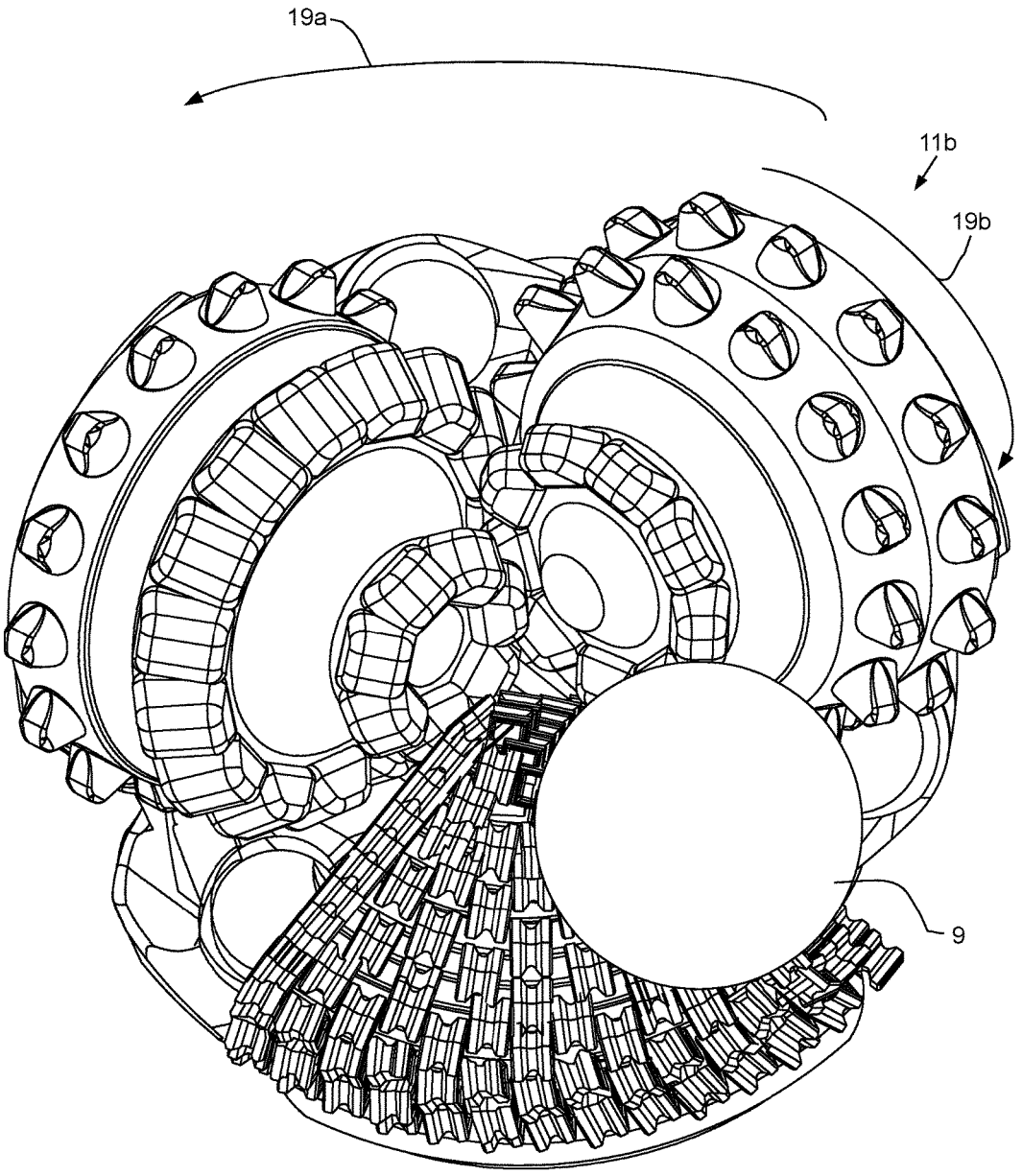
FIG. 6 illustrates the hybrid bit having captured a ball of the frac plug during drill out thereof.

FIG. 6 illustrates the hybrid bit 1 having captured the ball 9 of the frac plug 2 during drill out thereof. The interaction between the diverter groove 18*g* and the adjacent roller 11*b* cone may serve to catch and trap the ball 9 until the ball has been milled into a small enough piece of debris to travel through the junk slot 18*s*. Dressing the diverter groove 18*g* with the cutters 20 allows gripping of the ball 9 to discourage the ball from spinning as the hybrid bit 1 is milling the ball.

Alternatively, the diverter groove 18*g* may be configured to catch and trap other types of pump-down plugs, such as darts. Alternatively, the diverter groove 18*g* may not be dressed with the cutters 20.

Figure 7A:
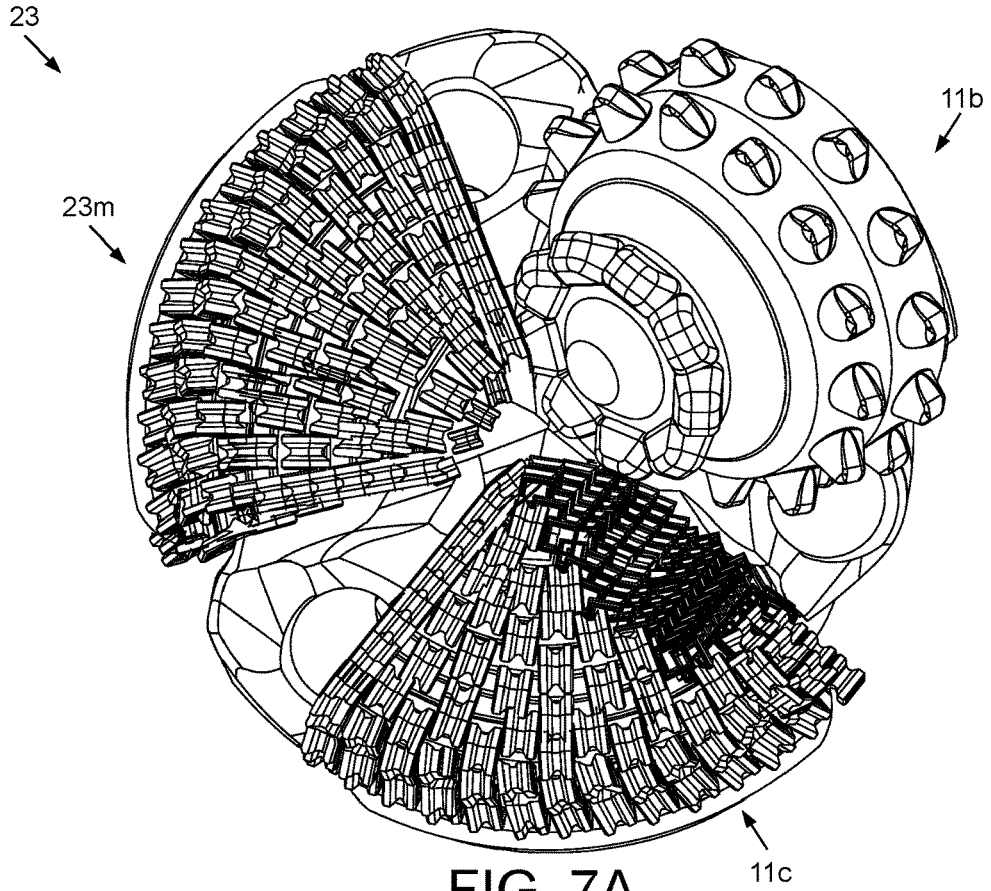
FIG. 7A illustrates an alternative hybrid bit, according to another embodiment of the present disclosure.

FIG. 7A illustrates an alternative hybrid bit 23, according to another embodiment of the present disclosure. The alternative hybrid bit 23 may include a modified body and a plurality of cutting structures, such as the roller cone 11*b* and a plurality of fixed mills 11*c*, 23*m*. The modified body 10 may be similar to the body 10 except for having a modified leg instead of the leg 10*a*. The modified leg may be similar to the leg 10*c* except that the mill pad thereof may have the diverter groove omitted therefrom.

Figure 7B:
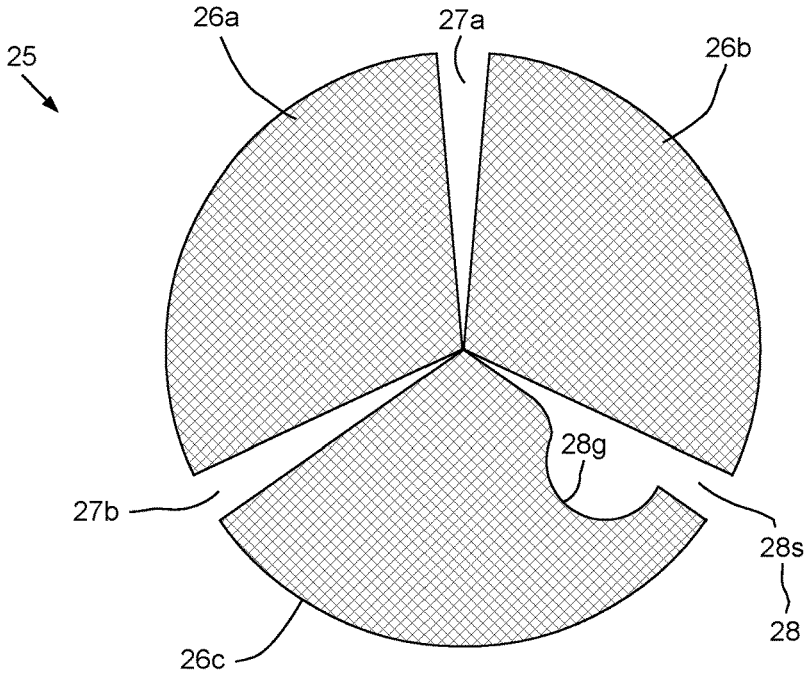
FIG. 7B illustrates a junk mill, according to another embodiment of the present disclosure.

FIG. 7B illustrates a junk mill 25, according to another embodiment of the present disclosure. The junk mill 25 may include a tubular body (not shown) and plurality (three shown) fixed cutting structures 26*a-c*. The body may have a coupling, such as a threaded pin, formed at an upper end thereof for assembly as part of a mill string, a flow bore therein, and ported bosses for discharging milling fluid onto the cutting structures. Each cutting structure 26*a-c* may include a pad (not shown) mounted to the body, such as by welding, and cermet material bonded to the pad, such as by hardfacing. The junk mill 25 may also have a first junk slot 27*a* formed between the cutting structures 26*a,b*, a second junk slot 27*b* formed between the cutting structures 26*a,c* and a junk chute 28. The junk chute 28 may include a diverter groove 28*g* and a junk slot 28*s* formed between the cutting structures 26*b,c* and having an entrance located adjacent to the diverter groove. The diverter groove 28*g* may be formed in a leading or trailing edge of the cutting structure 26*c*, dressed (not shown) with the cermet material, and may be configured to operate in a similar fashion to the diverter groove 18*g*.

Alternatively, the junk mill 25 may be dressed with the cutters 20 instead of being hardfaced.

While the foregoing is directed to embodiments of the present disclosure, other and further embodiments of the disclosure may be devised without departing from the basic scope thereof, and the scope of the invention is determined by the claims that follow.

The invention claimed is:

1. A hybrid bit for use in a wellbore, comprising:

a body having a shank for connection to a drilling motor or drill pipe and a plurality of legs attached to the shank; and a plurality of cutting structures, comprising:

a roller cone mounted to a first one of the plurality of legs; and a fixed mill mounted to a second one of the plurality of legs and comprising a pad dressed with a cermet material, wherein:

the plurality of cutting structures define a cutting face of the hybrid bit, an inner portion of the pad is located at a center of the cutting face, the cermet material is a plurality of cutter blocks brazed to the pad, the pad has a leading edge, a trailing edge, and a surface extending between the leading and trailing edges, each edge extends to the center of the cutting face, and at least the entire trailing edge and the entire surface are dressed with the plurality of cutter blocks.

2. The hybrid bit of claim 1, further comprising a junk chute for accommodating milling of a pump-down plug and comprising:

a diverter groove formed in the pad; and a junk slot formed between the first one of the plurality of legs and the second one of the plurality of legs and having an entrance located adjacent to the diverter groove.

3. The hybrid bit of claim 2, wherein the diverter groove is formed in the leading edge of the pad such that the roller cone rotates in a direction for driving the pump-down plug into the diverter groove.

4. The hybrid bit of claim 2, wherein the diverter groove is also dressed with the cermet material.

5. The hybrid bit of claim 2, wherein the diverter groove has an outer shoulder shaped for trapping the pump-down plug and an inner contour for directing the pump-down plug toward cutters of the roller cone.

6. The hybrid bit of claim 2, wherein the diverter groove is longitudinally inclined such that a size thereof is greatest adjacent to a bottom of the pad and decreases toward the junk slot for funneling the pump-down plug toward the junk slot.

7. The hybrid bit of claim 1, wherein the plurality of cutter blocks are brazed into grooves formed in the pad at a desired orientation.

8. The hybrid bit of claim 1, wherein:

each cutter block of the plurality of cutter blocks has a pair of opposite rectangular sides and four profiled sides connecting the rectangular sides, the profiled sides each have rectangular end portions located adjacent to the respective rectangular sides and profiled mid portions connecting the respective end portions, and each rectangular side has a raised peripheral portion and a recessed interior portion.

9. The hybrid bit of claim 8, wherein:

each rectangular end portion has chamfered corners adjacent to the respective rectangular sides, each profiled portion has a pair of opposed trapezoidal portions converging from the respective end portions toward a center of the respective cutter block of the plurality of cutter blocks, each profiled portion further has a filleted rectangular center portion connecting ends of the trapezoidal portions distal from the respective end portions, tapered walls connect each raised peripheral portion to the respective interior portion, and each corner of the tapered walls is shaved.

10. The hybrid bit of claim 1, wherein the plurality of cutter blocks are brazed on the pad such that a cutting edge thereof is over-exposed relative to a cutting edge of a cutting structure of the roller cone.

11. The hybrid bit of claim 1, wherein the plurality of cutter blocks are brazed on the pad such that a cutting edge thereof is under-exposed relative to a cutting edge of a cutting structure of the roller cone.

12. The hybrid bit of claim 1, wherein the plurality of cutter blocks are brazed on the pad such that a cutting edge thereof is equally exposed relative to a cutting edge of a cutting structure of the roller cone.

13. The hybrid bit of claim 1, wherein the second leg has a wrench profile formed therein.

14. The hybrid bit of claim 1, further comprising a second roller cone mounted to a third one of the plurality of legs, wherein the plurality of cutting structures consists only of three cutting structures.

15. The hybrid bit of claim 1, further comprising a second fixed mill mounted to a third one of the plurality of legs, wherein the plurality of cutting structures consists only of three cutting structures.

16. The hybrid bit of claim 1, wherein:

the roller cone has a nose row of cutters, each cutter of the nose row is a milled tooth or a cermet insert, and the nose row is located at the center of the cutting face.

17. The hybrid bit of claim 16, wherein each cutter of the nose row is the milled tooth.

18. The hybrid bit of claim 1, wherein a cutting edge of each of the plurality of cutter blocks is made from the cermet material.

19. A method of drilling out a plug, comprising:

assembling the hybrid bit of claim 1 as part of a mill string;

deploying the mill string into a casing or liner string set in the wellbore to the plug set in the casing or liner string; and injecting milling fluid through the mill string, rotating the hybrid bit, and engaging the hybrid bit with the plug, thereby drilling out the plug.

* * * * *